United States Patent [19]

Makio et al.

[11] Patent Number: 4,616,819

[45] Date of Patent: Oct. 14, 1986

[54] PAPER SHEET FEEDING ARRANGEMENT

[75] Inventors: Tatsumi Makio, Toyohashi; Kazumasa Hayakawa; Genta Sakaguchi, both of Toyokawa, all of Japan

[73] Assignee: Minolta Camera Kabushiki Kaisha, Osaka, Japan

[21] Appl. No.: 793,951

[22] Filed: Nov. 1, 1985

[30] Foreign Application Priority Data

Nov. 8, 1984 [JP] Japan ..... 59-169522[U]

[51] Int. Cl.[4] ..... B65H 3/52

[52] U.S. Cl. ..... 271/122; 271/164; 271/225; 271/902

[58] Field of Search ..... 271/122, 125, 225, 902, 271/162, 164

[56] References Cited

U.S. PATENT DOCUMENTS 4,284,269 8/1981 Ignatjev ..... 271/122
4,348,019 9/1982 Stievenart et al. .
4,372,676 2/1983 Miyata et al. .
4,496,145 1/1985 Fukui ..... 271/122

FOREIGN PATENT DOCUMENTS 56-65739 6/1981 Japan .

*Primary Examiner*—Richard A. Schacher
*Attorney, Agent, or Firm*—Burns, Doane, Swecker & Mathis

[57] ABSTRACT

A paper sheet feeding arrangement for feeding paper sheets one sheet by one sheet, including a paper sheet cassette, a paper feeding roller, a feed roller, a paper sheet separating roller rotated, in contact with the feed roller, in a direction counter to a paper feeding direction, a return roller provided rotatably and coaxially with one of the feed roller and the paper sheet separating roller, and a paper sheet returning device which, in response to release of the paper sheet cassette from a paper feeding section, not only brings the feed roller and the paper sheet separating roller out of contact with each other but rotates the return roller in the direction counter to the paper feeding direction.

8 Claims, 6 Drawing Figures

PAPER SHEET FEEDING ARRANGEMENT

BACKGROUND OF THE INVENTION

The present invention generally relates to paper feeding arrangements and more particularly, to a paper sheet feeding arrangement for feeding copy paper sheets one sheet by one sheet from a paper sheet cassette in a copying apparatus.

Conventionally, as a paper sheet feeding arrangement of the above described type, there has been proposed an arrangement in which a paper sheet cassette having copy paper sheets stacked therein is detachably mounted on a paper feeding section, while a feed roller and a paper sheet separating roller rotating in a direction counter to a paper feeding direction of the feed roller are provided forwardly of a paper feeding roller so as to extend in parallel with each other and vertically in contact with each other. In such a paper sheet feeding arrangement in which the copy paper sheets are separated from each other at a position disposed slightly forwardly of the paper sheet cassette, a paper feeding cycle of one of the copy paper sheets to be separated is completed in a state where a leading edge of the separated copy paper sheet has been transported to a contact point between the feeding roller and the paper sheet separating roller or has been gripped between the feeding roller and the paper sheet separating roller. Accordingly, when the paper sheet cassette is pulled out of the paper feeding section for replenishment of the copy paper sheets or replacement of the copy paper sheets with those of another size, such a problem arises that the separated copy paper sheet remains in the paper feeding section undesirably. Namely, it is troublesome to remove the copy paper sheet remaining in the paper feeding section. Furthermore, in the case where the paper sheet cassette is mounted on the paper feeding section without removing the copy paper sheet remaining in the paper feeding section, jamming of the copy paper sheet remaining in the paper feeding section takes place. Thus, in the paper sheet feeding arrangement of this kind, the copy paper sheet having its leading edge projecting out of the paper sheet cassette is required to be returned into the paper sheet cassette at the time when the paper sheet cassette is pulled out of the paper feeding section.

Furthermore, there is shown in FIGS. 1 to 3, a known paper sheet feeding arrangement provided with a lever type paper sheet returning mechanism for returning the copy paper sheet into a paper sheet cassette 60 mounted on the paper feeding section. A lifting lever 65 is pivotally projected into the cassette 60 upwardly from a bottom portion of the cassette 60 so as to be pivoted about a support shaft 67. A paper sheet support plate 61 having the copy paper sheets placed thereon is upwardly urged, at its front end portion, by the lifting lever 65 such that the upper face of the uppermost one of the copy paper sheets placed on the support plate 61 is brought into pressing contact with a paper feeding roller 80. When the paper feeding roller 80 is driven so as to be rotated counterclockwise, the uppermost one of the copy paper sheets placed on the support plate 61 is transported in the rightward direction in FIG. 1 together with one or more copy paper sheets through friction therebetween. Namely, at this time, two or more copy paper sheets are transported simultaneously by the paper feeding roller 80.

Meanwhile, a feed roller 30 and a paper sheet separating roller 40 rotating in the direction counter to the paper feeding direction are rotatably provided in contact with each other at the position forwardly of the paper feeding roller 80 and are each driven for counterclockwise rotation thereof. Therefore, the uppermost one of the copy paper sheets transported by the paper feeding roller 80 is fed in the rightward direction in FIG. 1 through counterclockwise rotation of the feed roller 30 and is further transported to a transfer section of a photosensitive drum (not shown) by a pair of transport rollers 85. However, travel of the remaining copy paper sheets transported by the paper feeding roller 80 is prevented through counterclockwise rotation of the paper sheet separating roller 40 so as to be stopped at the paper sheet separating roller 40.

As shown in FIG. 2, the paper sheet returning mechanism includes a return lever 20 mounted on a rotatable shaft 21, an arm 22 secured to one end portion of the shaft 21, and an arm 23 secured to a rotatable shaft 24. The arm 22 is formed with an elongated opening 22*a*. The arms 22 and 23 are coupled with each other by driving a pin 23*a* into the arm 23 through the elongated opening 22*a*. Meanwhile, an ejector arm 25 provided, at its distal end, with a roller 26 is fixed to the shaft 24. The arms 23 and 25 are urged to rotate in the counterclockwise direction by a torsion spring 27 wound around the shaft 24.

A front face of the cassette 60 inserted into the paper feeding section is brought into contact with the roller 26. Thus, the cassette 60 is depressed rearwardly in the leftward direction in FIG. 2 by an urging force of the torsion spring 27. Consequently, since a claw portion 15*a* of a lock lever 15 is positively brought into engagement with a lock hole 62 of the cassette 60 as shown in FIG. 1, the cassette 60 is securely positioned.

Meanwhile, a mechanism for releasing upward urging of the lifting lever 65 for the paper sheet support plate 61 includes a release operating lever 70, a release lever 73 and a retainer lever 75. The release operating lever 70 is upwardly urged about a shaft 71 by a torsion spring 72. The release lever 73 is provided, at its distal end, with a roller 74 and is secured to the support shaft 67 of the lifting lever 65. The retainer lever 75 is mounted on a shaft 76 and is urged in the clockwise direction in FIG. 2 about the shaft 75. Namely, when the release operating lever 70 is depressed downwardly, the lifting lever 65 is downwardly pivoted about the support shaft 67 together with the release lever 73. Thus, the release lever 73 is locked through engagement of the roller 74 of the release lever 73 with a step portion 75*a* of the retainer lever 75. At the same time, since a lock release lever 16 is downwardly pivoted by the roller 66 of the lifting lever 65, the lock lever 15 is pivoted downwardly and thus, the claw portion 15*a* of the lock lever 15 is disengaged from the lock hole 62 of the cassette 60 such that the cassette 60 is unlocked. It is to be noted that the lock lever 15 and the lock release lever 16 are rotatably mounted on a shaft 17 and are urged upwardly by torsion springs 18 and 19, respectively as shown in FIG. 3.

When the cassette 60 is unlocked as described above, the cassette 60 is thrusted out slightly in the leftward direction in FIG. 2 by the ejector arm 25 which is urged to rotate about the shaft 24 in the counterclockwise direction by an urging force of the torsion spring 27. At this time, the arm 23 is pivoted counterclockwise and the arm 22 is pivoted clockwise relative to the counterclockwise rotation of the arm 23. Therefore, since the return lever 20 is pivoted clockwise about the shaft 21, the remaining copy paper sheets are returned into the cassette 60 by a distal end of the return lever 20. Here, the remaining copy paper sheets are those stopped by the paper sheet separating roller 40 with their front ends proceeding up to the position between the feed roller 30 and the paper sheet separating roller 40.

However, the above described lever type paper sheet returning mechanism of the known paper sheet feeding arrangement has such drawbacks that the remaining copy paper sheets stopped by the paper sheet separating roller 40 can be returned into the cassette 60 by the return lever 20 only in the case where the remaining copy paper sheets stopped by the paper sheet separating roller 40 are disposed within a travel stroke of the return lever 20 and that since the feed roller 30 and the paper sheet separating roller 40 are held in contact with each other, the remaining copy paper sheets stopped by the paper sheet separating roller 40 may be damaged when being gripped, at the front ends, between the feed roller 30 and the paper sheet separating roller 40.

SUMMARY OF THE INVENTION

Accordingly, an essential object of the present invention is to provide a paper sheet feeding arrangement in which remaining copy paper sheets stopped by a paper sheet separating roller can be positively returned into a cassette at all times, also in the case where front ends of the remaining copy paper sheets are gripped between a feed roller and the paper sheet separating roller, with substantial elimination of the disadvantages inherent in conventional paper sheet feeding arrangements of this kind.

In order to accomplish this object of the present invention, a paper sheet feeding arrangement for feeding paper sheets one sheet by one sheet, embodying the present invention comprises: a cassette for accommodating a stack of the paper sheets, which is detachably mounted on a paper feeding section; a paper feeding roller for feeding the paper sheet in a paper feeding direction from said cassette; a feed roller for transporting the paper sheet fed by said paper feeding roller; a paper sheet separating roller which is radially brought into contact with said feed roller and is rotated in a direction counter to the paper feeding direction; said feed roller and said paper sheet separating roller being provided forwardly of said paper feeding roller in the paper feeding direction; a return roller which is rotatably provided coaxially with one of said feed roller and said paper sheet separating roller and is formed, at its outer peripheral portion, with a cutoff face such that said cutoff face confronts a feed passage of the paper sheet when the paper sheet is fed by said paper feeding roller; and a paper sheet returning means which, in response to release of said cassette from said paper feeding section, not only brings said feed roller and said paper sheet separating roller out of contact with each other but rotates said return roller in the direction counter to the paper feeding direction, whereby the paper sheet gripped between said feed roller and said paper sheet separating roller is returned into said cassette.

By the above described arrangement of the paper sheet feeding arrangement of the present invention, when the cassette is detached from the paper feeding section, the feed roller and the paper sheet separating roller are brought out of contact with each other and the return roller is rotated in the direction counter to the paper feeding direction, whereby the remaining copy paper sheets stopped between the feed roller and the paper sheet separating roller are returned into the cassette.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 3:
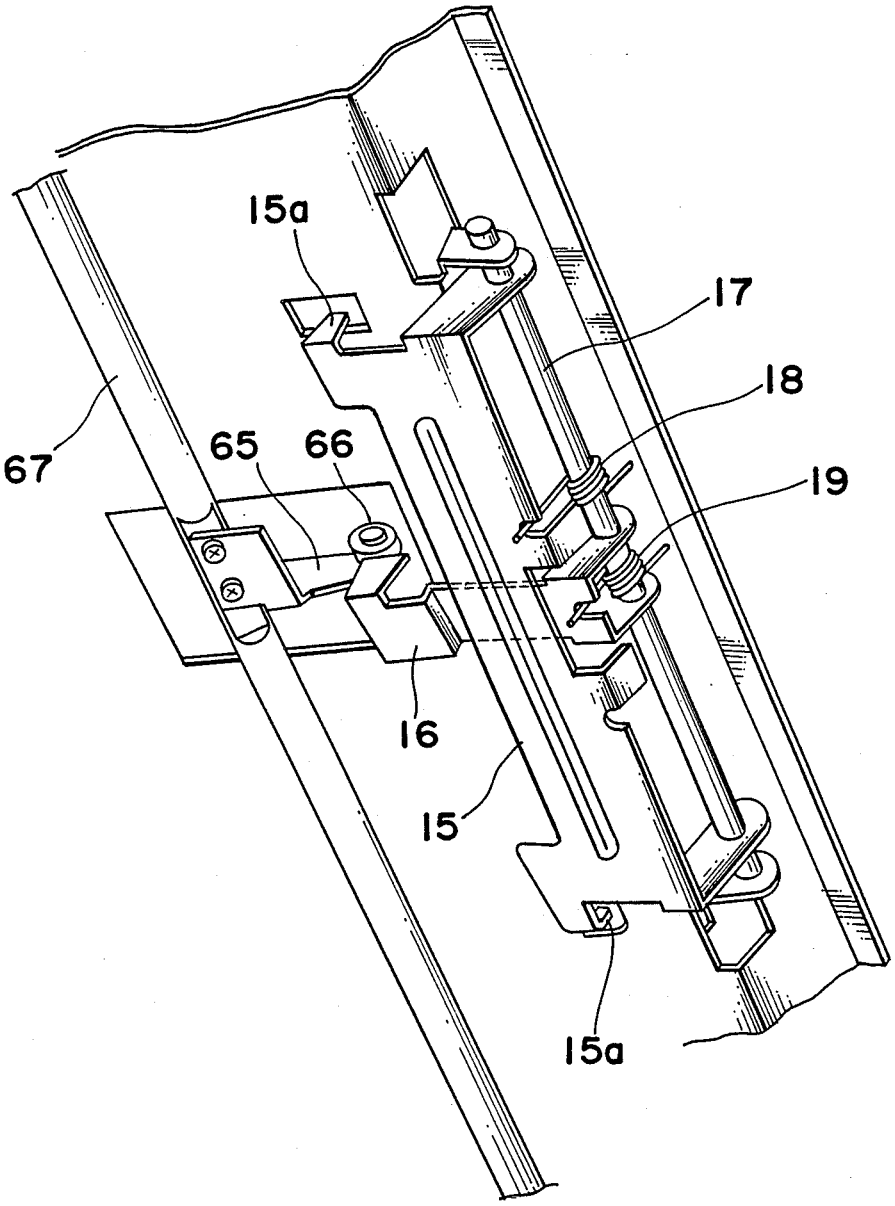
Fig. 3 PRIOR ART
FIG. 3 is a perspective view of the prior art paper sheet feeding arrangement of FIG. 1 as viewed from its bottom portion (already referred to)
Figure 4:
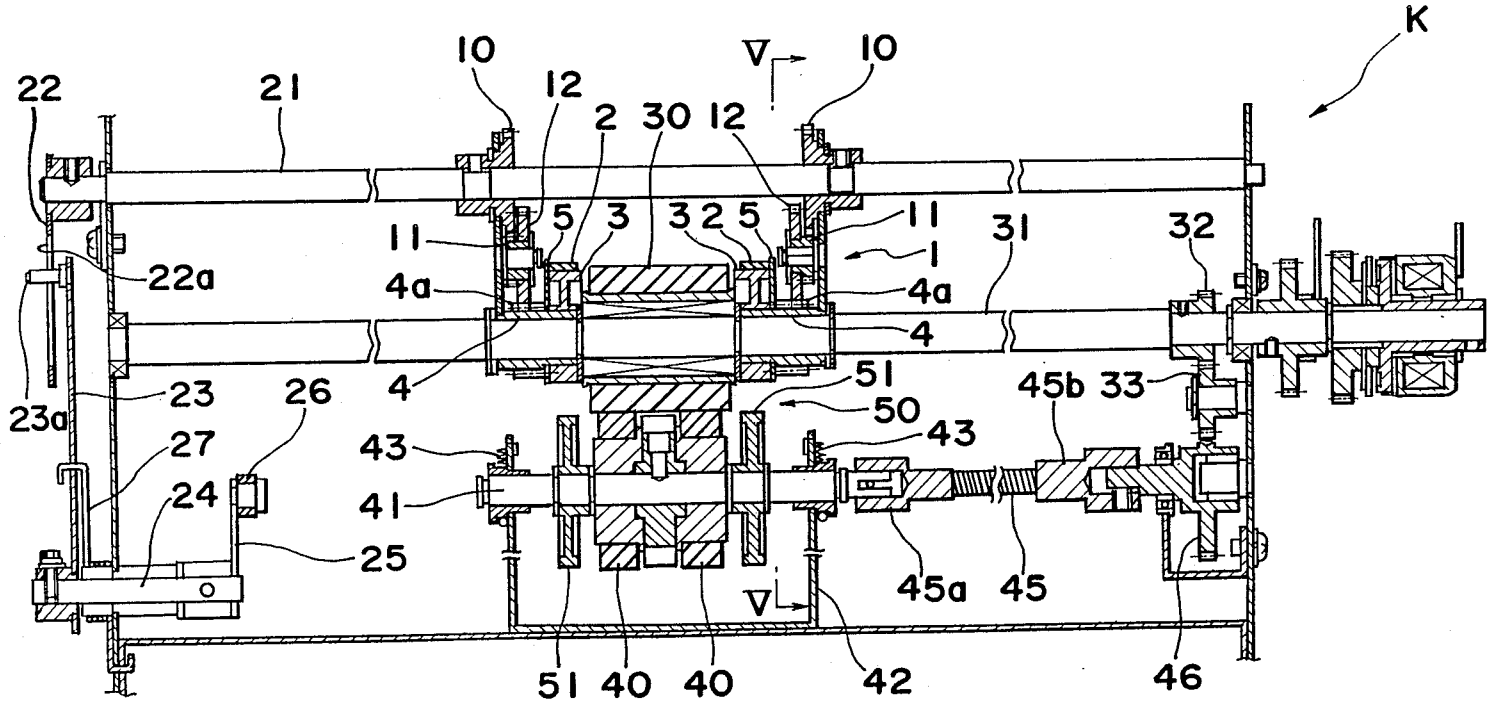
FIG. 4 is a vertical sectional view of a paper sheet separating mechanism employed in a paper sheet feeding arrangement according to one preferred embodiment of the present invention.
Figure 5:
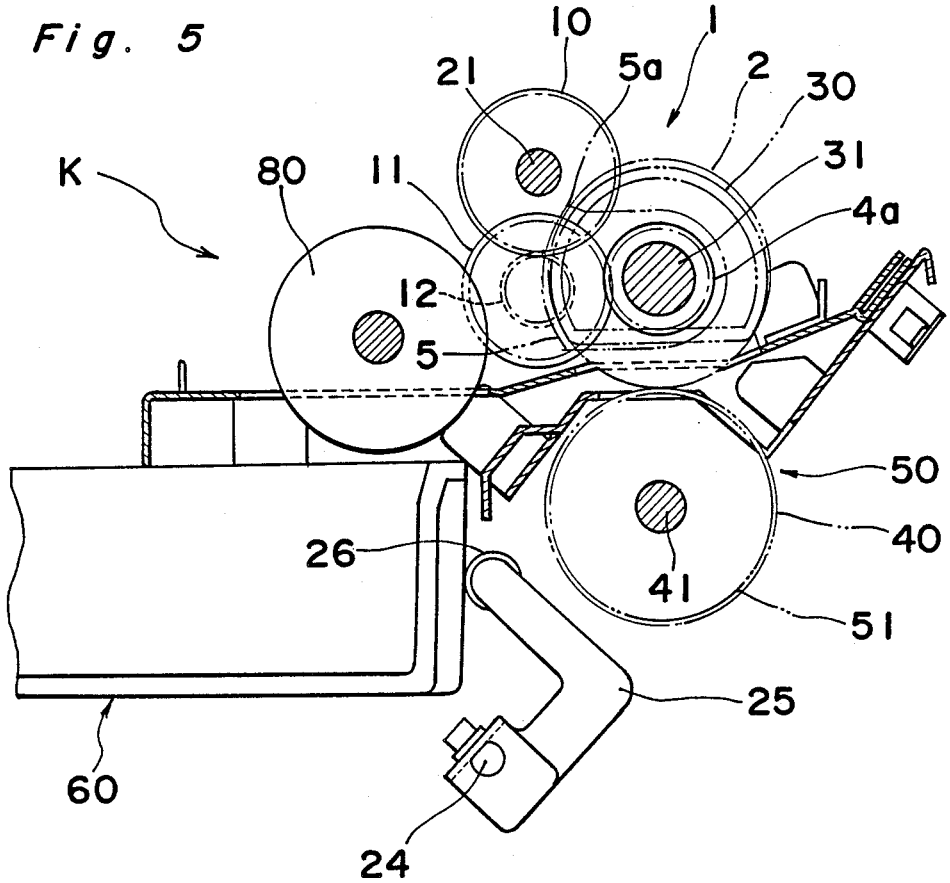
FIG. 5 is a cross-sectional view taken along the line V—V in FIG. 4.
Figure 6:
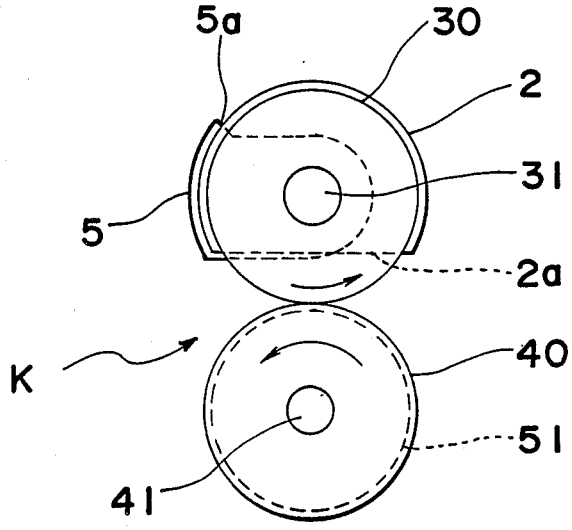
FIG. 6 is a side elevational view of a feed roller, a paper sheet separating roller and a return cam roller employed in the paper sheet feeding arrangement of FIG. 4.

Referring now to the drawings, there is shown in FIGS. 4 to 6, a paper sheet feeding arrangement K for a copying apparatus, according to one preferred embodiment of the present invention. The paper sheet feeding arrangement K includes a paper sheet returning mechanism 1 having a pair of return cam rollers 2, and a contact release mechanism 50 for bringing out of contact with each other a feed roller 30 and a paper sheet separating roller 40 rotating in a direction counter to a paper feeding direction. It should be noted that other constructions of the paper sheet feeding arrangement K are similar to those of the prior art paper sheet feeding arrangement of FIGS. 1 to 3 referred to earlier.

The paper sheet returning mechanism 1 includes a pair of base plates 3, a pair of bushings 4 and a feed roller shaft 31 having the feed roller 30 mounted thereon. Each of the return cam rollers 2 is made of rubber having a high coefficient of friction and is formed into a shape obtained by cutting off a portion from its circular outer periphery, for example, substantially a D-shape, a shape of sector, a semicircular shape, etc. Each of the return cam rollers 2 is mounted on an outer periphery of each of the base plates 3 which are secured to the bushings 4, respectively. Meanwhile, the bushings 4 are rotatably mounted, at opposite sides of the feed roller 30, on the feed roller shaft 31. The return cam rollers 2 are larger, in diameter, by about 2 mm than the feed roller 30.

Figure 1:
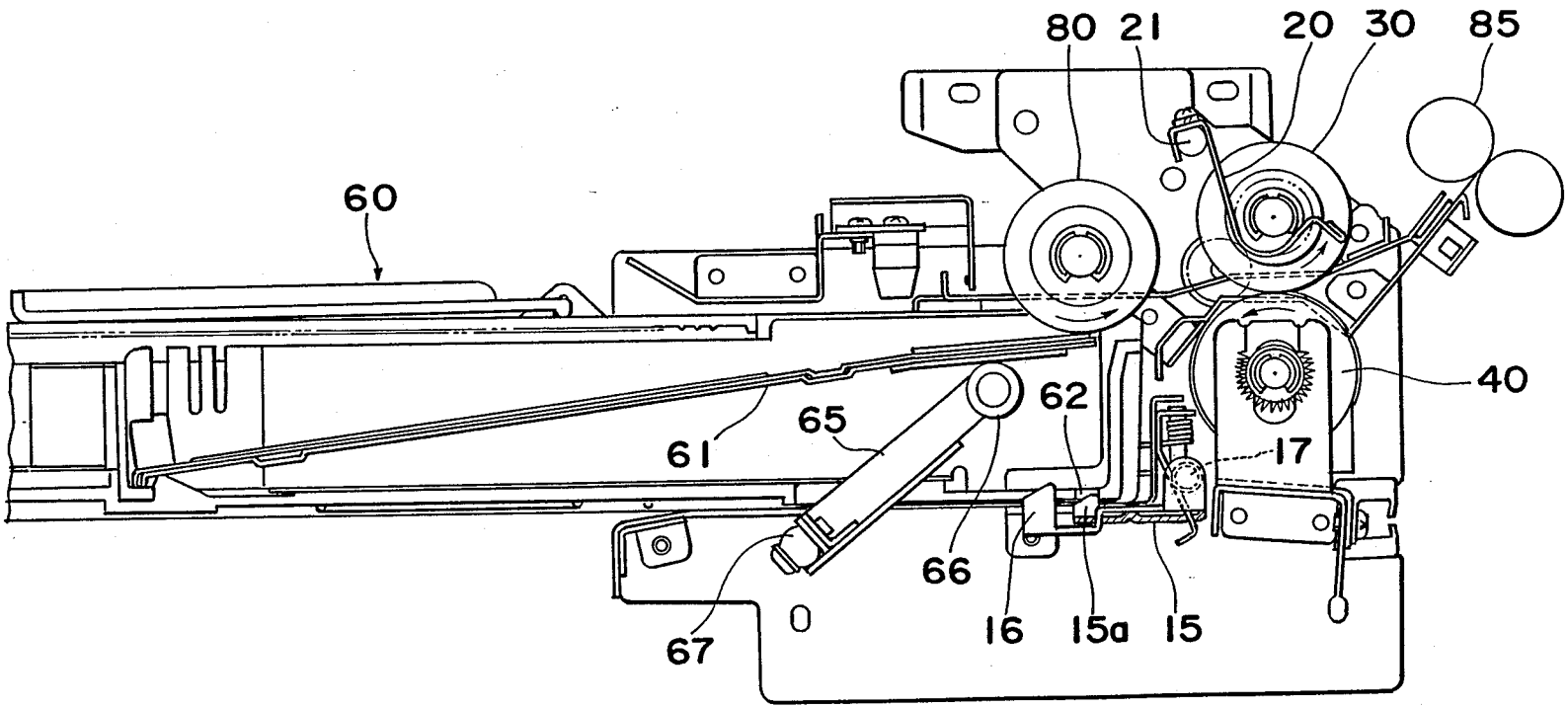
Fig. 1 PRIOR ART
FIG. 1 is a side elevational view of a prior art paper sheet feeding arrangement (already referred to)
Figure 2:
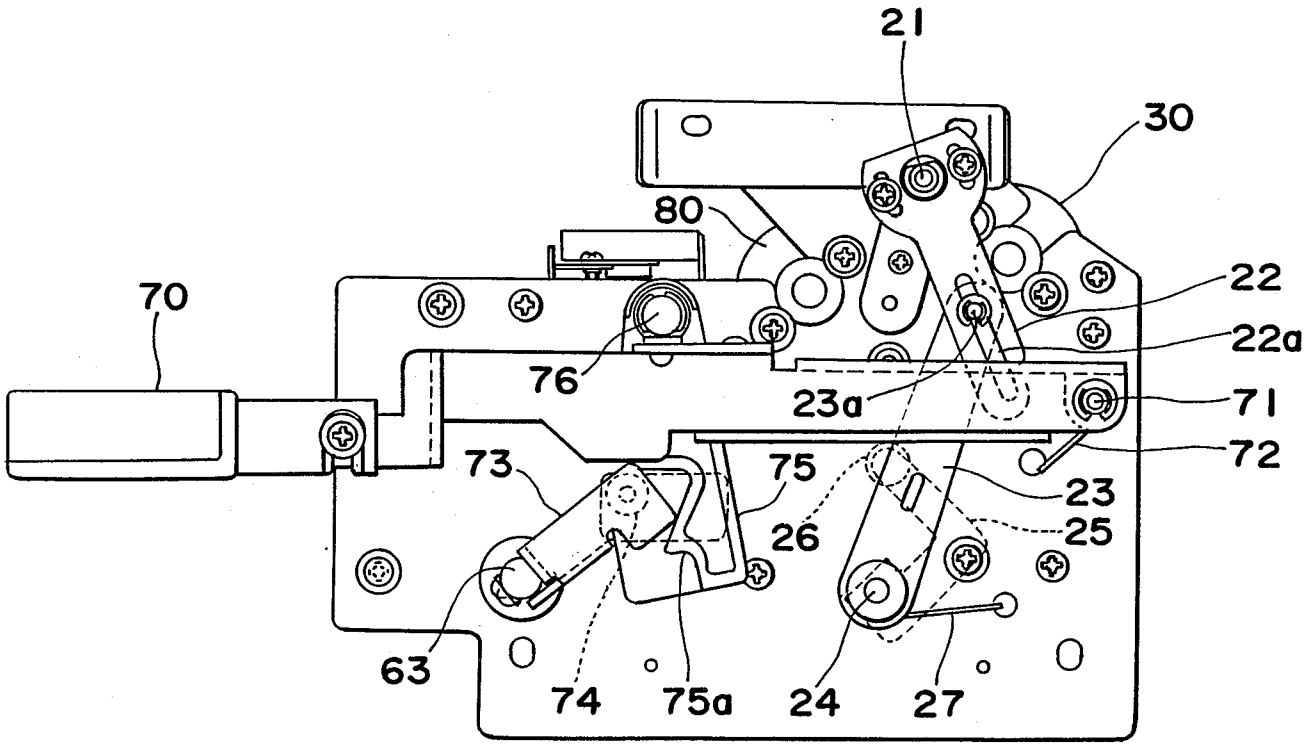
Fig. 2 PRIOR ART
FIG. 2 is a fragmentary side elevational view of the prior art paper sheet feeding arrangement of FIG. 1 (already referred to)

As shown in FIG. 4, the paper sheet returning mechanism 1 further includes an arm 22 secured to one end portion of a rotatable shaft 21, an arm 23 secured to a rotatable shaft 24 and an ejector arm 25 fixed to the shaft 24 in the same manner as the known paper sheet feeding arrangement of FIGS. 1 to 3. The arm 22 is formed with an elongated opening 22*a*. The arms 22 and 23 are coupled with each other by driving a pin 23*a* into the arm 23 through the elongated opening 22*a*. Meanwhile, the ejector arm 25 is provided, at its distal end, with a roller 26. The arms 23 and 25 are urged to rotate in the counterclockwise direction in FIG. 2 about the shaft 24 by a torsion spring 27 wound around the shaft 24. A pair of gears 10 mounted on the shaft 21 are, respectively, brought into engagement with a pair of gears 11 which are coaxially secured to a pair of gears 12, respectively. Each of the gears 12 is in mesh with a tooth portion 4*a* formed on an outer periphery of each of the bushings 4.

Furthermore, the paper sheet returning mechanism 1 includes a pair of paper sheet returning plates 5, each of which is secured to one side of each of the return cam rollers 2. Each of the paper sheet returning plates 5 is formed with a circular outer peripheral portion having a diameter slightly larger than that of each of the return cam rollers 2 and is formed, at one side of the circular outer peripheral portion, with an edge portion 5*a* as shown in FIG. 6.

Meanwhile, the paper sheet separating roller 40 is mounted, immediately below the feed roller 30, on a shaft 41. The shaft 41 is vertically movably mounted on a bracket 42 and is urged upwardly at all times by a pair of coiled springs 43 attached to the bracket 42. One end of the shaft 41 is coupled with a joint 45*a* provided at one end of a coiled spring 45 for transmitting a rotary driving force, while a joint 45*b* provided at the other end of the coiled spring 45 is coupled with a shaft portion of a gear 46. The rotary driving force is transmitted from a main motor (not shown) to the feed roller shaft 31 and then, is transmitted from a gear 32 mounted on the feed roller shaft 31 to the gear 46 through an intermediate gear 33.

The contact release mechanism 50 for bringing the feed roller 30 and the paper sheet separating roller 40 out of contact with each other includes a pair of rollers 51. The rollers 51 are rotatably mounted, at opposite sides of the paper sheet separating roller 40, on the shaft 41. The rollers 51 have an outermost diameter of about 0.2 mm smaller than that of the paper sheet separating roller 40 and confront the return cam rollers 2, respectively. Namely, when the return cam rollers 2 have been rotated in the clockwise direction through about 90° from their position shown in FIGS. 5 and 6, the return cam rollers 2 are, respectively, brought into contact with the rollers 51. Therefore, the paper sheet separating roller 40 is displaced slightly downwardly together with the rollers 51 and the paper sheet separating roller 40 is brought out of contact with the feed roller 30. Thus, the contact release mechanism 50 is constituted by the rollers 51 and the return cam rollers 2.

In the paper sheet feeding arrangement K of the above described construction, a paper sheet cassette 60 is mounted on or detached from a paper feeding section in the same manner as the known paper sheet feeding arrangement of FIGS. 1 to 3. Namely, when the cassette 60 is inserted into the paper feeding section, a front face of the cassette 60 is brought into contact with the roller 26 of the ejector arm 25, so that the ejector arm 25 is pivoted about the shaft 24 in the clockwise direction in FIG. 5 and thus, the arm 22 and the shaft 21 are pivoted in the counterclockwise direction in FIG. 2 through the arm 23. At the same time, rotation of the shaft 21 is transmitted to the return cam rollers 2 by way of the gears 10, 11 and 12, the bushings 4 and the base plates 3. Each of the return cam rollers 2 is formed with a cutoff portion 2*a*. When an outer periphery of each of the return cam rollers 2 is retracted away from a paper feed passage such that the cutoff portion 2*a* of each of the return cam rollers 2 confront each of the rollers 51, namely the cutoff portion 2*a* of each of the return cam rollers 2 confront the paper feed passage as shown in FIGS. 5 and 6, feeding of the copy paper sheets is performed. When a plurality of the copy paper sheets have been transported at a time by a paper feeding roller 80, an uppermost one of the copy paper sheets is further transported by the feed roller 30, but further travel of the remaining lower ones of the copy papers sheets is stopped through counterclockwise rotation of the paper sheet separating roller 40. The remaining copy paper sheets stopped by the paper sheet separating roller 40 are stopped at the position between the feed roller 30 and the paper sheet separating roller 40 or are stopped in a state where leading edges of the remaining copy paper sheets are gripped between the feed roller 30 and the paper sheet separating roller 40.

At this time, in order to pull the cassette 60 out of the paper feeding section, when the cassette 60 has been unlocked by depressing downwardly a release operating lever (not shown but corresponding to the release operating lever 70 of FIG. 2), the ejector arm 25 and the arm 23 are pivoted in the counterclockwise direction in FIG. 2 and the arm 22 is pivoted in the clockwise direction in FIG. 2. Therefore, since the gears 10 are also rotated in the clockwise direction in FIG. 5 synchronously with the shaft 21, the return cam rollers 2 are rotated in the clockwise direction in FIG. 5 via the gears 11 and 12 and the bushings 4. Thus, when the outer periphery of each of the return cam rollers 2 has been brought into contact with the outer periphery of each of the rollers 51, the paper sheet separating roller 40 is displaced downwardly together with the rollers 51, so that the paper sheet separating roller 40 is brought out of contact with the feed roller 30. Accordingly, the remaining copy paper sheets stopped between the feed roller 30 and the paper sheet separating roller 40 are gripped between the return cam rollers 2 and the rollers 51 and then, are returned into the cassette 60 through clockwise rotation of the return cam rollers 2 and counterclockwise rotation of the rollers 51 driven by the return cam rollers 2. Even if the remaining copy paper sheets stopped by the paper sheet separating roller 40 are insufficiently returned into the cassette 60 through slip of the remaining copy paper sheets relative to the feed roller 30 and the paper sheet separating roller 40, the edge portion 5*a* of each of the paper sheet returning plates 5 rotating synchronously with the return cam rollers 2 is brought into engagement with the leading edges of the remaining copy paper sheets and thus, the remaining copy paper sheets are positively returned into the cassette 60.

Meanwhile, the paper sheet feeding arrangement of the present invention is not limited to the above described embodiment but can be modified variously. For example, it can also be so arranged that the return cam rollers 2 are not mounted on the feed roller shaft 31 but on the shaft 41 for the paper sheet separating roller 40. Meanwhile, in order to bring the feed roller 30 and the paper sheet separating roller 40 out of contact with each other, it is also possible to retract the feed roller 30 away from the paper sheet separating roller 40. Furthermore, it is also possible to retract the paper sheet separating roller 40 away from the feed roller 30 not through rotation of the return cam rollers 2, but directly in association with pivotal movement of the ejector arm 25 or the release operating lever 70.

Meanwhile, although the return cam rollers 2 are formed larger, in its outermost diameter, than the feed roller 30 in the above described embodiment, it is also possible to form the return cam rollers 2 slightly smaller, in outermost diameter, than the feed roller 30 by setting an axial distance between the return cam rollers 2 and the feed roller 30 at a larger value. However, in this case, the rollers 51 for retracting the paper sheet separating roller 40 away from the feed roller 30 are required to be formed larger, in outside diameter, than the paper sheet separating roller 40.

Furthermore, rotation of the return cam rollers 2 is mechanically associated with an operation for removing the cassette 60 from the paper feeding section in the above described embodiment. However, it can also be so arranged that manipulation of the release operating lever is detected by a microswitch or the like such that the return cam rollers 2 are rotated by a solenoid, etc. in response to a detection signal from the microswitch.

As is clear from the foregoing description, in accordance with the present invention, since the copy paper sheets projecting out of the cassette are returned into the cassette by using the rollers in place of the return lever, the rollers are brought into contact with even the copy paper sheets disposed out of the travel stroke of the return lever and thus, the copy paper sheets are positively returned into the cassette.

Furthermore, in accordance with the present invention, since the feed roller and the paper sheet separating roller are brought out of contact with each other when the copy paper sheets are returned into the cassette, even the copy paper sheets gripped between the feed roller and the paper sheet separating roller can be securely returned into the cassette without being damaged.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A paper sheet feeding arrangement for feeding paper sheets one sheet by one sheet, comprising:

a cassette for accommodating a stack of the paper sheets, which is detachably mounted on a paper feeding section;

a paper feeding roller for feeding the paper sheet in a paper feeding direction from said cassette;

a feed roller for transporting the paper sheet fed by said paper feeding roller;

a paper sheet separating roller in contact with said feed roller and rotatable in a direction counter to the paper feeding direction;

said feed roller and said paper sheet separating roller being provided forwardly of said paper feeding roller in the paper feeding direction;

a return roller which is rotatably provided coaxially with one of said feed roller and said paper sheet separating roller and is formed, at its outer peripheral portion, with a cutoff face such that said cutoff face confronts a feed passage of the paper sheet when the paper sheet is fed by said paper feeding roller; and a paper sheet returning means associated with the release action of said cassette from said paper feeding section for bringing said feed roller and said paper sheet separating roller out of contact with each other and causing said return roller to rotate in the direction counter to the paper feeding direction, whereby the paper sheet gripped between said feed roller and said paper sheet separating roller is returned into said cassette.

2. A paper sheet feeding arrangement as claimed in claim 1, wherein said paper sheet returning means includes a driven roller which is provided coaxially with the other one of said feed roller and said paper sheet separating roller, said driven roller being driven for rotation thereof by said return roller upon rotation of said return roller so as to return into said cassette the paper sheet gripped between said feed roller and said paper sheet separating roller.

3. A paper sheet feeding arrangement as claimed in claim 2, wherein said return roller has an outside diameter larger than that of said one of said feed roller and said paper sheet separating roller.

4. A paper sheet feeding arrangement as claimed in claim 3, wherein said driven roller has an outside diameter smaller than that of said other one of said feed roller and said paper sheet separating roller.

5. A paper sheet feeding arrangement as claimed in claim 2, wherein said paper sheet separating means further includes a paper sheet returning plate which is provided coaxially with said return roller so as to be rotated together with said return roller.

6. A paper sheet feeding arrangement as claimed in claim 4, wherein said paper sheet separating means further includes a paper sheet returning plate which is provided coaxially with said return roller so as to be rotated together with said return roller.

7. A paper sheet feeding arrangement as claimed in claim 5, wherein said paper sheet returning plate is formed with a circular outer peripheral portion, said circular outer peripheral portion having an outside diameter larger than that of said return roller and being provided, at one side thereof, with an edge portion such that the paper sheet gripped between said feed roller and said paper sheet separating roller is returned into said cassette by said edge portion.

8. A paper sheet feeding arrangement as claimed in claim 6, wherein said paper sheet returning plate is formed with a circular outer peripheral portion, said circular outer peripheral portion having an outside diameter larger than that of said return roller and being provided, at one side thereof, with an edge portion such that the paper sheet gripped between said feed roller and said paper sheet separating roller is returned into said cassette by said edge portion.

* * * * *